United States Patent [19]

Fasnacht

[11] 3,942,275

[45] Mar. 9, 1976

[54] READING SCROLL MACHINE

[76] Inventor: Dennis W. Fasnacht, 504 E. Bowery St., Iowa City, Iowa 52240

[22] Filed: Feb. 10, 1975

[21] Appl. No.: 548,282

[52] U.S. Cl. ..... 40/31; 40/104 A

[51] Int. Cl.[2] ..... G09J 11/28

[58] Field of Search ..... 40/31, 30, 104 A, 86 R, 40/341, 343, 347, 52 A, 53 R; 335/205 200/81 H; 81 R; 81.9 M; 83 L

[56] References Cited

UNITED STATES PATENTS

| | | | |
|---|---|---|---|
| 1,076,091 | 10/1913 | Allen | 200/81 H |
| 3,174,241 | 3/1965 | Rohan | 40/31 X |
| 3,569,648 | 3/1971 | De Meyer | 200/81.9 M |

FOREIGN PATENTS OR APPLICATIONS

| | | | |
|---|---|---|---|
| 262,429 | 6/1968 | Austria | 200/832 |

*Primary Examiner*—John H. Wolff
*Attorney, Agent, or Firm*—Glenn H. Antrim

[57] ABSTRACT

The pages of a book are placed on a long strip of paper for making a scroll. The machine for winding the scroll has rollers positioned for displaying any desired portion to be read. A motor for rotating the rollers is controlled by a magnetic switch that is easily operated by inflating an air bag. The bag may be inflated either by having a person squeeze a bulb connected through a tube to the bag, or by having a severely handicapped person hold the end of a tube in his mouth and blow into the tube.

3 Claims, 5 Drawing Figures

READING SCROLL MACHINE

BACKGROUND OF THE INVENTION

This invention relates to devices for changing displays of reading material and more particularly to devices that turn pages of books or otherwise advanced reading material for physically handicapped persons.

Many people have been injured by disease or accidents to the extent that they cannot hold and turn the pages of books, and many of these are paralyzed below the neck so that any required movement for controlling operation of any device is limited to movement of the head and organs of the face. Often the physically handicapped can read well when a book is properly positioned for them and the pages are turned as required. Machines for turning the pages of books are quite complicated and require much care to maintain them in operation.

SUMMARY OF THE INVENTION

The present device receives books that have been rolled as scrolls so that the complicated movements of turning pages are eliminated. A portion of the book that is being read is displayed between two rollers, and as the reading material is to be advanced, a motor is operated to drive one of the rollers. The driven roller is connected to an electric motor through a gear reducer, and a switch connected to the motor can be easily operated by a severely handicapped person. The switch of a preferred embodiment is a magnetically operated reed switch in which a magnet for operating the switch is moved easily by inflation of an air bag. The air bag can be inflated either by squeezing a rubber bulb, or by the user blowing directly into a hose connected to the air bag. The magnet for operating the switch is attached to the end of a leaf spring, and the opposite end of the spring is mounted to a surface adjacent to the switch. The air bag is positioned between the leaf spring and the adjacent surface such that when the bag is inflated the free end of the spring having the magnet is moved outwardly a short distance from the magnetic switch.

DESCRIPTION OF THE PREFERRED EMBODIMENT

Figure 1:
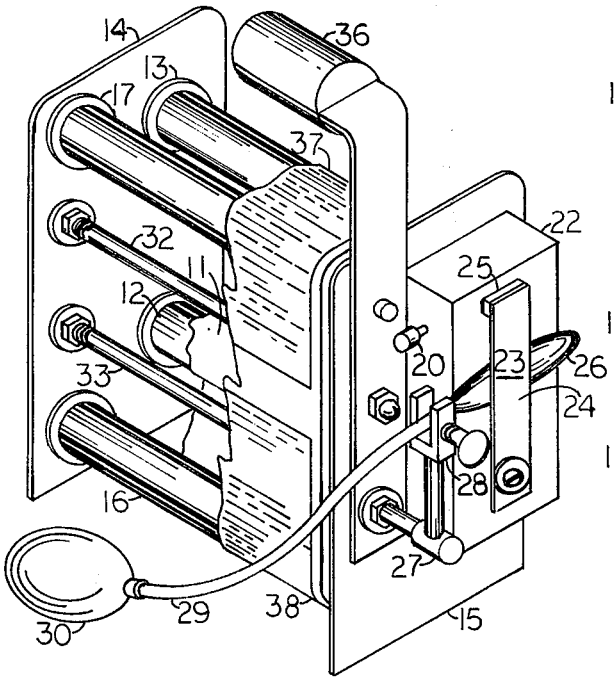
FIG. 1 is a front perspective view of a reading scroll machine of this invention with a portion of the scroll cut away.
Figure 2:
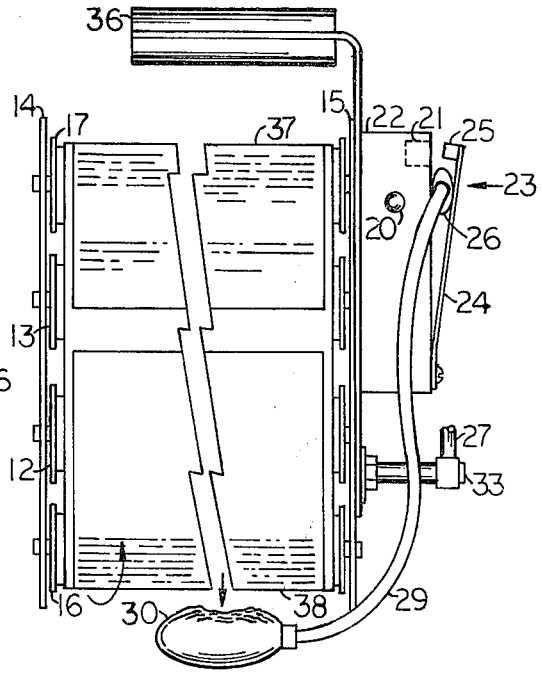
FIG. 2 is a front view of the scroll machine showing operation of its magnetic switch.
Figure 3:
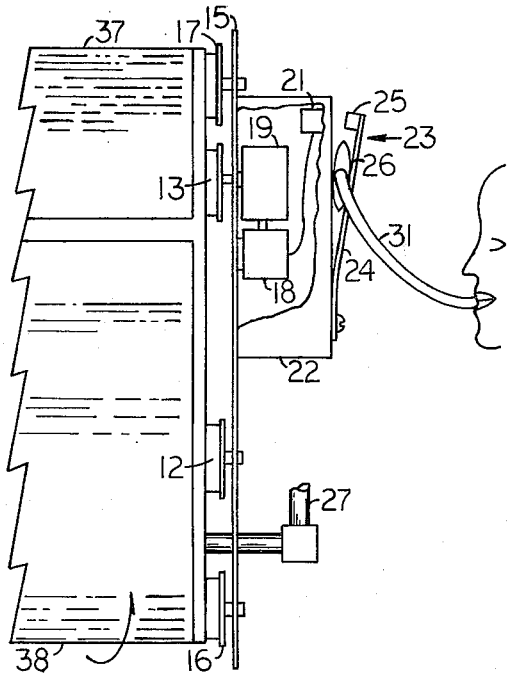
FIG. 3 is a partial front view of the reading scroll machine showing operation of the magnetic switch by a different means.

A book 11 in the form of a scroll is wound off a roller 12 onto a roller 13 shown in FIGS. 1 and 2. The rollers 12 and 13 are rotatively mounted with their axes parallel between the rectangular, end plates 14 and 15. The roller 13 is mounted somewhat above the roller 12, the rollers being mounted between the rear portions of the end plates 14 and 15. Additional guide or idle rollers 16 and 17 are mounted parallel to the rollers 12 and 13 near the lower and upper front corners respectively of the end plates 14 and 15. With reference to FIG. 3, an electric motor 18 and a gear reducer 19 are mounted on the outer face of the end plate 15. An output shaft of the motor 18 is rotatively connected through the gear reducer 19 to the shaft of the roller 13 in a conventional manner.

Figure 5:
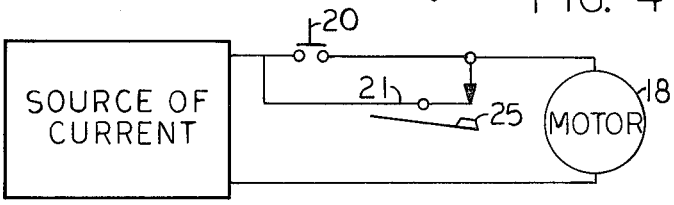
FIG. 5 is a schematic diagram to show the use of the magnetic switch in a usual motor control circuit.

One of the usual two power leads used in the circuit of the motor 18 is connected through parallel push-button switch 20 (FIG. 2) and magnetic switch 21 (FIGS. 2 and 3) to the motor. A conventional electrical circuit with the magnetic switch 21 is shown in FIG. 5. The push-button switch 20 is mounted through the side of a non-magnetic cover 22 that faces the front of the machine, and the magnetic switch 21 is mounted inside the end of the cover 22 parallel with the end plate 15. The cover is fastened to the outer face of the end plate 15 to cover the motor 18 and the reducer 19 and to provide a rigid mounting for an actuator 23 of the magnetic switch 21.

The actuator 23 comprises a leaf spring 24, and the lower end of the leaf spring is secured to the bottom portion of the outside face of the cover 22 so that the spring extends upwardly adjacent the middle portion of the face of the cover. In order to operate the magnetic switch 21, a magnet 25 is fastened across the inside upper end of the leaf spring 24. The length of the leaf spring is such that the magnet 25 is opposite the magnetic switch 21 that is on the inside surface of the end of the cover 22. The magnetic switch 21 is preferably a reed switch that is actuated by a magnetic field of moderate strength. According to the present use, the magnetic switch 21 is normally closed by the force of spring tension alone, but in this circuit the switch is normally open because the force of the field of the adjacent magnet 25 is greater than the spring tension. The lower end of the leaf spring 24 is curved slightly outwardly to provide sufficient space for an empty bag or balloon of thin rubber material or a flexible membrane over an enclosure to fit loosely between the leaf spring 24 and the end of the cover 22.

A bracket 27 secured to the end plate 15 extends outwardly and upwardly in front of the cover 22 with an outer portion nearly even with the end of the cover 22. The upper end of the bracket 27 has a clamp 28 that is approximately even with the horizontal, central portion of the end of the cover 22.

The tension of the leaf spring 23 is weak so that the magnet 25 can be easily moved outwardly from its normal position. While the magnet 25 is in its normal position, the magnetic switch 21 is open and the motor 18 is not operating. When the reading material on the book 11 is to be changed, a handicapped person can easily inflate the bag 26 to cause the magnet 25 to be moved far enough away from the magnetic switch 21 as shown in FIG. 2 to permit the reed switch 21 to close. The motor 18 operates and rolls the book 11 upwardly until the bag 26 is no longer inflated.

The bag 26 can be inflated through the use of a flexible tube 29 and a bulb 30 as shown in FIGS. 1 and 2, or by the use of a flexible tube 31 only as shown in FIG. 3. The bag 26 is attached to one end of either the tube 29 or the tube 31. The selected tube is placed in the clamp 28 and the clamp is tightened to hold the tube and to maintain the bag between the leaf spring 24 and the end of the cover 22. The bulb 30 is flexible, and if it is used, it is obviously attached to the opposite end of the tube 29.

Figure 4:
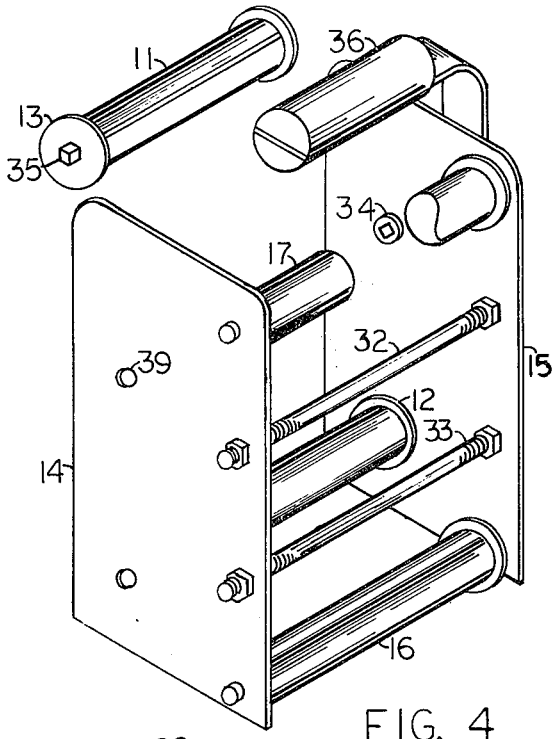
FIG. 4 is a perspective front view of the machine with a scroll removed.

As shown in FIG. 4, the end plates 14 and 15 are spaced the required distance by bolts or spacers 32 and 33 to receive the rollers 12, 13, 16, and 17. The bolts 32 and 33 are mounted horizontally between the front portions of the end plates 14 and 15. The end plates 14 and 15 have a moderate amount of spring tension so that the rear portions of the plates can be spread apart sufficiently for inserting or removing the book rollers 12 and 13. For uniformity and convenience, each of the rollers has an axial shaft with a square end 35 extending beyond guiding flanges on the ends of the rollers. Except for one end of the roller 13 that is to be coupled to the gear reducer 19, the ends of the rollers extend through round openings 39 in the end plates 14 and 15, the openings having sufficient diameter to permit the rollers 12, 13, 16, and 17 to be rotated freely while they are positioned between the end plates 14 and 15. In FIG. 4, the square socket 34 having an inward face about even with the inside surface of the end plate 15, is the output coupling of the gear reducer 19. Any of the square shafts 35 is a sliding fit in the square opening of the socket 34.

Assume that a book 11 has been completely read, and that it is to be positioned for another reading. With reference to FIG. 4, force is applied to the rear portions of the end plates 14 and 15 to spread them apart sufficiently to remove an empty roller 12 and a full roller 13. To rewind the book 11, the roller 13 is turned end for end and placed in the bottom position shown occupied by the roller 12. The empty roller 12 is then placed between the end plates 14 and 15 so that the square shaft at one end of the roller fits into the square socket 34. The end of the book is then fed below and up around the lower front roller 16, up over the upper front roller 17, and started on the empty roller 12 that has been coupled to the gear reducer 19. An operator then presses the actuator of the push-button switch 20 to operate the motor 18 until the book is completely wound on the previously empty roller 12. Obviously, the book will appear to travel backward and will be upside down while it is being rewound. After the book is rewound onto the roller 12, the roller is turned end for end and placed in the lower position as shown in FIG. 4. It is then placed about the rollers 16 and 17 as previously described and started on the empty roller 13 that has been returned to its original position.

The reading scroll machine is then placed in front of the reader, and a bag 26 supplied with a desired inflating device is placed between the actuator 23 and the adjacent surface of the cover 22. For handling, a handle 36 is located conveniently above the frame of the machine. If the reader can move any portion of his body a substantial amount, the bulb 30 can be placed so that the reader can squeeze the bulb as shown in FIG. 2 for inflating the bag 26 to cause operation of the motor 18. When required, the bag 26 can be merely supplied with the tube 31, and the end of the tube be placed in the mouth of the reader for inflating the bag

26 by the breath of the reader. After a portion of the book has been read, the reader inflates the bag 26 for operating the motor 18 that drives the roller positioned in the socket 34. The reading matter then moves upwardly between the rollers 16 and 17 until the reader releases the pressure on the bag 26 to stop the new material that has been brought into view between the rollers 16 and 17.

The book or scroll 11 can be readily prepared from two paper-back books, a long sheet of paper, and adhesive. Conveniently, two pages of the book can be placed side by side in positions corresponding to that shown for the pages 37 in FIG. 1 and the next pages can be placed side by side in the position shown for the page 38.

I claim:

1. A reading scroll machine comprising:

first and second rollers, a book to be rolled like a scroll between said rollers, a frame, said frame having supporting means for rotatively mounting said rollers and displaying a plane portion of said book that is unwound between said rollers, means for viewing said unwound portion from outside said frame, an electric motor, means for rotatively coupling said motor to one of said rollers, a magnetic switch connected to said motor for controlling the operation thereof, an actuator for operating said switch comprising a leaf spring having a magnet on the free end thereof, said switch and said leaf spring being juxtaposed, said actuator being operable easily to change the distance between said magnet and said magnetic switch for operating said switch between an off-position and an on-position, an enclosure with an exposed flexible membrane, mounting means for holding said enclosure adjacent said actuator and switch such that outward movement of said membrane operates said actuator and thereby operates said magnetic switch to said on-position, means for selectively filling said enclosure with air under low pressure, said enclosure while filled with air under pressure causing said membrane to press against said actuator for operating said switch to said on-position to cause said motor to operate, and the operation of said motor rotating said one of said rollers and thereby sequentially displaying different portions of said book.

2. A reading scroll machine as claimed in claim 1 wherein said means for filling said enclosure with air includes a flexible bulb, and a tube interconnecting said enclosure and said bulb.

3. A reading scroll machine as claimed in claim 1 wherein said means for filling said enclosure with air includes a tube, said tube connected to said enclosure and adapted to permit said enclosure to be filled by the breath of a person reading said book.

* * * * *